United States Patent [19]

Cocchi et al.

[11] Patent Number: 4,755,111

[45] Date of Patent: Jul. 5, 1988

[54] PUMPING DEVICE, PARTICULARLY SUITABLE FOR COMPRESSING FLUIDS ON DEEP SEA-BOTTOMS

[75] Inventors: Vittorio Cocchi, Florence; Vasco Mezzedimi, Poggibonsi, both of Italy

[73] Assignee: Nuovopignone Industrie Meccaniche e Fonderia S.p.A., Florence, Italy

[21] Appl. No.: 57,014

[22] Filed: Jun. 1, 1987

[30] Foreign Application Priority Data

Jun. 11, 1986 [IT] Italy ..... 20758 A/86

[51] Int. Cl.[4] ..... F04B 43/10

[52] U.S. Cl. ..... 417/394; 92/103 F

[58] Field of Search ..... 417/394, 395, 393; 92/103 F, 103 SD

[56] References Cited

U.S. PATENT DOCUMENTS

| | | | |
|---|---|---|---|
| 2,673,525 | 3/1954 | Lucas | 417/395 X |
| 2,738,731 | 3/1956 | Browne | 417/394 X |
| 3,227,314 | 1/1966 | Porter et al. | 417/395 X |
| 3,496,879 | 2/1970 | Brandes | 417/395 X |
| 3,523,857 | 8/1970 | Crosland | 92/103 F X |
| 3,749,526 | 7/1973 | Ferrentino | 417/394 X |
| 4,008,008 | 2/1977 | Vergnet | 417/394 X |
| 4,406,596 | 9/1983 | Budde | 417/393 |

FOREIGN PATENT DOCUMENTS

| | | | |
|---|---|---|---|
| 3522711 | 1/1986 | Fed. Rep. of Germany | 92/103 F |

*Primary Examiner*—Leonard E. Smith

*Attorney, Agent, or Firm*—Hedman, Gibson, Costigan & Hoare

[57] ABSTRACT

Hydraulic-exchange pumping device comprising two containers or tanks, inside each of which there are defined: a chamber for the product to be pumped, which is respectively connected, through a delivery valve and a suction valve, to the lines of delivery and of intake of the product to be pumped, as well as a chamber for the hydraulic drive fluid, which is connected to a pump through a four-way, three-position distribution box. This partitioning is accomplished by means of an internal elastic membrane having a decreasing thickness from the its peripheral edge towards its central zone, which can be also equipped with a strengthening cloth embedded inside it, as well as with a set of metal rings having a cross-section surface area decreasing towards the center of the same membrane.

5 Claims, 2 Drawing Sheets

PUMPING DEVICE, PARTICULARLY SUITABLE FOR COMPRESSING FLUIDS ON DEEP SEA-BOTTOMS

The present invention relates to a pumping device which, by allowing also mixtures heterogeneous and containing large amounts of gas and of particulate solid matter or dirt to be efficaciously compressed, makes it possible to achieve a more efficacious and cheap exploitation of the offshore oil-fields.

It is known that in the last times, solving the problem of a rational exploitation of offshore oil-fields has become more and more pressing.

According to the present state of the art, the traditional operating pattern of this exploitation provides the arrival of the crude product, generally constituted by oil, gas, water, and miscellaneous sediments, to an offshore platform on which the phase separation is carried out: thereafter, the oil either is pumped towards the mainland through a submarine pipeline, or is stored in tanks subsequently conveyed to the mainland by tankers, whilst the gas is, in some cases, re-injected into the reservoir, or, in other cases, is on the contrary delivered to the mainland through a further specific submarine pipeline.

From the above, the high burdensomeness and complexity can be realized of the traditional exploitation pattern, which, besides requiring a plurality of submarine pipelines, requires always the use of a large offshore platform for housing the cumbersome and heavy systems for separation and processing of crude product.

On the other hand, this pattern of the prior art does not allow those oil-fields to be profitably exploited, which are positioned in areas wherein the construction or the operation of an offshore platform result problematic, both due to technical and financial reasons. Representative examples are constituted by wells in very deep waters, wherein the use of stationary platforms results prohibitive from the financial viewpoint, or by wells situated in the arctic seas, wherein the presence of icebergs renders expensive and complex the construction and operation of platforms.

A rational solution for the exploitation of the above mentioned oil-fields, which would allow the platforms to be eliminated, would consist in performing the direct pumping towards the mainland of the crude product, viz., the not separated, not processed heterogeneous mixture, hence generally containing large amounts of solid particulate matter or miscellaneous sediments, as well as of gas, by means of a pumping unit provided on the sea-bottom in the nearby of the well mouth.

Such a solution, in fact, by not requiring any kinds of platforms, would allow an evident, considerable reduction to be achieved not only in the necessary investments, but also in the operation costs, in as much as the conveyance would be carried out by one single pipeline only, and furthermore the execution simpleness would also allow an easy exploitation to be performed of offshore pockets not exploited up to date because of their particular location, or abandoned, because they are regarded as not being any longer profitably exploitable by the techniques of the prior art.

Unfortunately, for practicing the above said solution, pumping devices are necessary, which are able to operate in the presence of large contents of free gas, and with heterogeneous mixtures comprising variable percentages of solid particulate matter, what presently none of existing pumps are able to do.

In fact, the centrifugal type of pump, which, by being sturdy and able to easily handle the solid particulate matter existing inside the heterogeneous mixture, would seem the ideal pump for the said offshore application, actually does not function at all when the gas content at its intake port exceeds certain values (more than about 30% by volume). In the presence of such values of gas content, rotary machines of volumetric type could be used, such as the screw pumps, but their operation would become problematic both in case of large gas amounts and in case of presence, as it generally occurs, of particulate solid matter which would render necessary uncomfortable servicing performances at the sea-bottom and at short time intervals, with consequent intolerable cost increases. The dragging of particulate solid matter renders also problematic the use of the piston pumps, wherein the functioning is bound to the life of the sealing components of the same piston.

From the prior art, also known are the hydraulic-exchange pumps, in which a membrane made from an elastomeric material separates the liquid to be handled from the hydraulic drive oil, but even these pumps, which are purposely designed for an efficacious pumping of liquids, cannot be used for mixtures containing a certain gas amount, in as much as they are not able to avoid that, during the movement of approaching of the membrane to the inner wall of the chamber occupied by the mixture to be compressed, entrained gas pockets may remain, which, by acting as a noxious volume, prevent the required high compression ratios from being achieved.

Summing up, no pumping devices exist presently, which allow the crude product to be extracted from the offshore well and to be directly conveyed to the mainland.

The purpose of the present invention is precisely to obviate the above-said drawback and to supply hence a pumping device which allows even heterogeneous mixtures, containing large amounts of gas and of solid particulate matter, to be efficaciously compressed.

This purpose is achieved by means of a particular hydraulic-exchange pump, substantially constituted by two containers or tanks, perfectly identical to each other, and each partitioned into two parts by an internal elastic membrane having a decreasing thickness from its peripheral edge, fastened onto the middle of the container, towards its centre, with both of one of said two parts of said two containers being connected with the intake line for the product to be pumped, through an intake valve, and with a delivery line for the product to be pumped, through a delivery valve, whilst the other two parts of the container are destined to the drive hydraulic fluid which is alternatively transferred from the one to the other part by means of a pump and of a distribution box.

The shape of the elastic membrane is such as to oblige it to deform in such as way that, during the pumping step, it comes to adhere to the inner surface of the container first in correspondence of its peripheral, larger-thickness zone, and finally in correspondence of its central zone, wherein the delivery valve of the device is located, what guarantees that no gas pockets are formed and hence that the noxious volume is zero, and, consequently, that the complete expulsion of the product is achieved, both whether it is a liquid, or a gas.

On the other side, in as much as the above said pumping device is generally destined to operate at the sea-bottom in high-depth waters, according to a preferred form of embodiment of the invention, the above-said two containers or tanks are given a spherical shape, which is the most suitable for efficaciously withstanding high hydrostatic pressures.

The distribution box used is then of the four-way, three-position type, so that, whilst in the two extreme positions of the distribution box the two tanks are respectively connected to the delivery port and to the intake port of the pump, and vice-versa, viz., the hydraulic fluid is intaken from a tank and delivered to the other tank, and vice-versa, it is possible to establish, in the intermediate position of the box, a mutual connection of the two tanks, and of the pump delivery and intake ports, so that the oil pressure is balanced and water hammerings are avoided during the switching steps.

The switching of the distribution box is furthermore automatically achieved by means of a stop device of the "proximity" type, or of mechanical type, provided in each one of the two containers or tanks, which switches its position every time that the central portion of the elastic membrane, so pushed by the intaken product, comes to completely adhere to the inner wall of the same tank.

Then, to the purpose of endowing the elastic membrane with a higher mechanical strength, according to a further characteristic of the present invention, said membrane is provided, besides the linearly variable thickness, with a cloth made from a natural (cotton) or synthetic material, embedded inside it.

Finally, in order to increase the shape stability of the membrane during its excursions, and cause the deformations thereof to be always symmetrical relatively to the symmetry axis perpendicular to the plane of fastening of the membrane to the container or tank body, what secures an optimum functioning of the membrane, and, consequently, of the whole device, according to a further characteristic of the present invention, the membrane is provided with a set of metal rings located concentrically to each other and parallelly to the plane of fastening of the membrane to the container or tank body, said rings of said set having a cross-section surface area decreasing from the periphery towards the centre of the membrane.

The invention is now explained in greater detail by referring to the hereto attached drawings, which illustrate a preferential form of practical embodiment, supplied to purely exemplifying, non-limitative purpose, in that technical or structural variants may always be supplied without exiting the scope of the present invention.

Figures 1, 2, 3:
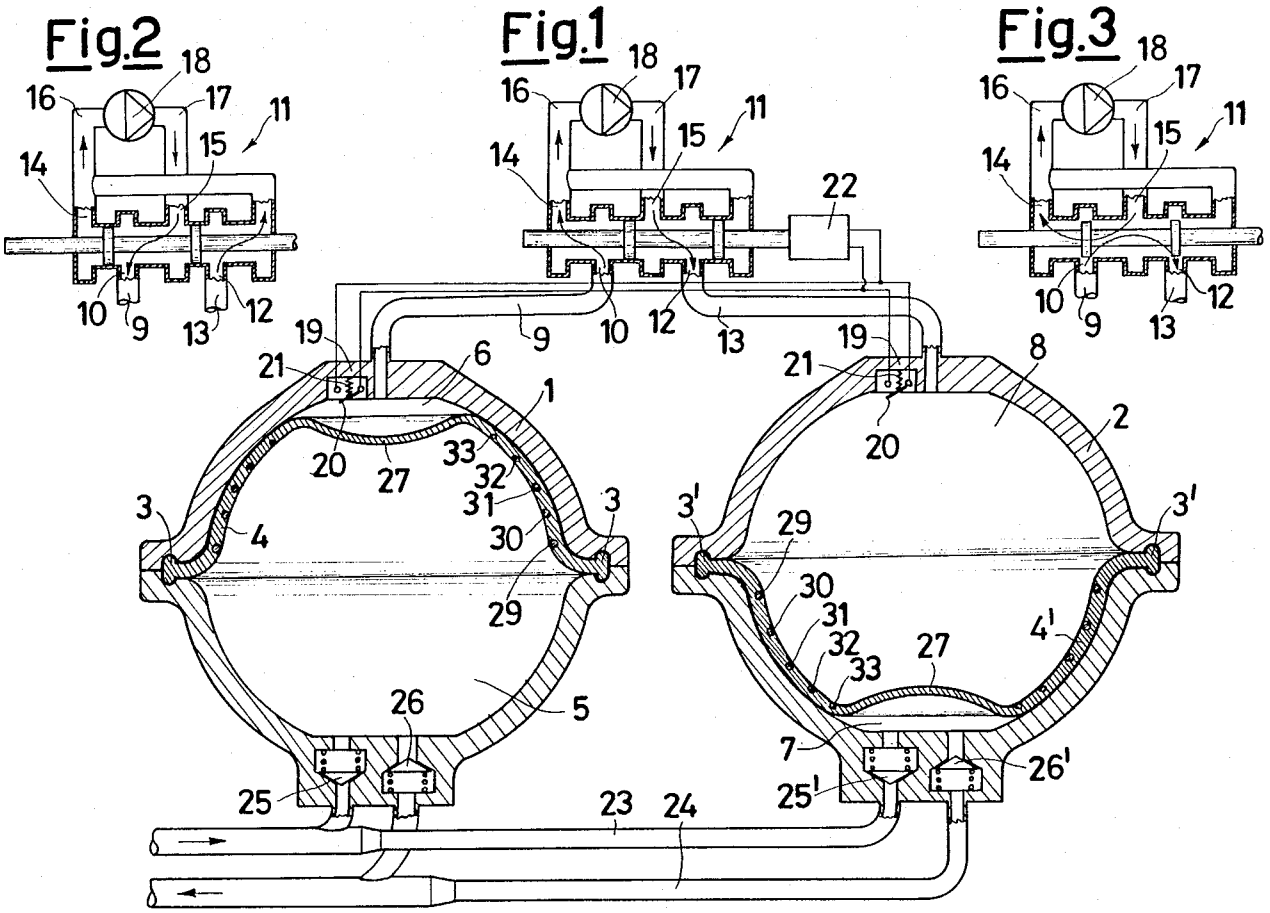
FIG. 1 shows a schematic sectional view of a pumping device according to the invention, with the distribution box being in an extreme positions.
FIG. 2 shows the connections with the distribution box of FIG. 1 being in its other extreme position.
FIG. 3 shows the connections with the distribution box of FIG. 1 being in its intermediate position.

Referring to the drawings, with 1 and 2 two containers or tanks are respectively shown, which are perfectly equal to each other, and have a spherical shape, each of which supports, in correspondence of its horizontal middle plane, the edge 3 or 3' of an internal elastic membrane 4 or 4' which defines, in this way, two chambers, respectively 5 or 7, for the crude product to be pumped, and 6 or 8, for the hydraulic drive fluid.

The upper portion of chamber 6 of tank 1 is then connected, by means of duct 9, with one way 10 of a four-way, three-position distribution box 11, the other way 12 of which is connected, on the contrary, through the duct 13, with the upper portion of the corresponding chamber 8 of tank 2. The other two ways 14 and 15 of the distribution box 11 are instead respectively connected to the intake port 16 and to the delivery port 17 of pump 18.

At the upper end of each of chambers 6 and 8 a stop device is furthermore provided, housed inside a suitable hollow 19 provided inside the body of the same tank, which is constituted by a switch 20 controlled by a return spring 21, which closes, in cooperation with the central part 27 of the elastic membrane 4 or 4', the electrical circuit of excitation of the control device 22 which controls the switching of the distribution box 11.

The two chambers 5 and 7 are instead connected, in correspondence of their lowermost part, both with the intake line 23 for the crude product to be pumped, and with the delivery line 24 for said crude product, through respectively an intake valve 25 or 25' controlled by a downwards-acting return spring, and a delivery valve 26 or 26' controlled by an upwards-acting return spring.

The said internal elastic membrane 4 or 4' has furthermore a thickness which decreases from its peripheral edge 3 towards its central part 27 and is mechanically strengthened by means of a cloth 28 (see specifically FIG. 4) made from cotton, or from a synthetic material, embedded inside it. Furthermore, in order to increase its shape stability during its deformations, the membrane is provided with a plurality of metal rings 29, 30, 31, 32, 33, . . . , having a cross-section surface area decreasing in that order, and located concentrically to each other and parallelly to the horizontal middle plane of same tank.

Figure 4:
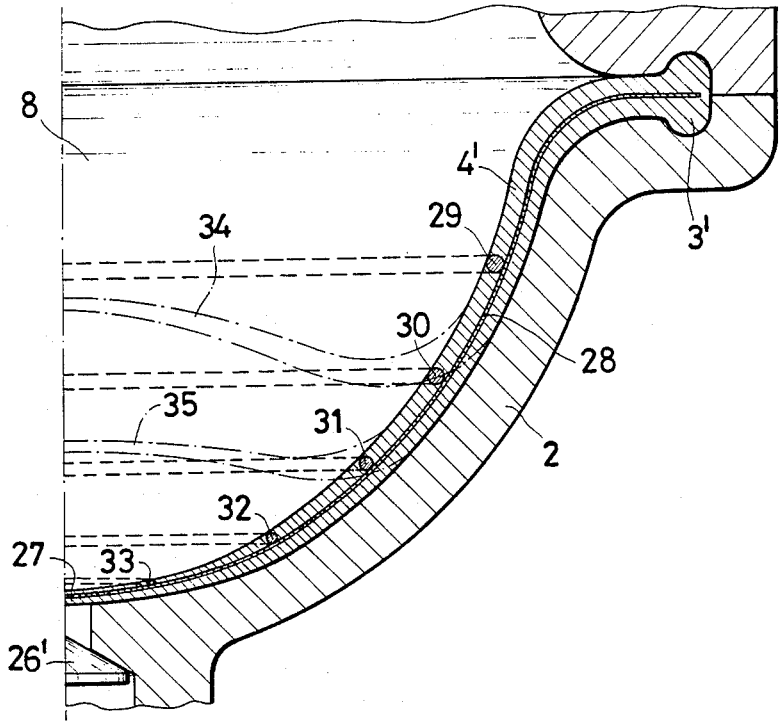
FIG. 4 shows a sectional partial view on an enlarged scale of the sequential deformations taken by the elastic membrane of the device of FIG. 1.

Such a profile and shape forces the elastic membrane 4 or 4' to deform as schematically indicated in FIG. 4, wherein, besides the end position of the membrane, shown by continuous lines, also the intermediate positions 34 and 35 are shown. It can be seen that during the pumping step the elastic membrane 4' comes to adhere to the inner surface of tank 2 first in correspondence of its higher-thickness peripheral zone, and finally in correspondence of its central zone 27, in correspondence of the delivery valve 26', with the consequent complete expulsion of the product, whether it is a liquid or a gas.

The operating way of such a device is evident.

By starting from the condition as illustrated in FIG. 1, the vacuum generated inside the chamber 6 of tank 1 by the pump 18 which delivers the hydraulic fluid into the chamber 8 of tank 2, causes the crude product to be intaken, through the valve 25, into the chamber 5 of tank 1, whilst the crude product contained inside the chamber 7 of tank 2 is expelled into the delivery line 24 through the valve 26'. When the crude product has completely filled the chamber 5, and the membrane 4 has thus come to completely adhere to the inner surface of tank 1, the closure of switch 20 causes the distribution box 11 to switch into the configuration as of FIG. 2, so that the cycle is repeated with the tanks being exchanged, viz., with tank 1 expelling the crude product, and tank 2 intaking it. On the other hand, the said switching of the distribution box 11 brings this latter, before to the configuration as of FIG. 2, to the intermediate configuration of FIG. 3, which equalizes the pressures inside chambers 6 and 8, thus preventing water hammerings.

We claim:

1. A pumping device comprising:

(a) two identical containers;

(b) an internal elastic membrane partitioning each container into two chambers, each of said membranes having a decreasing thickness from its peripheral edge towards its central part and fixed at said edge to the middle of said container;

(c) a plurality of metal rings in each of said membranes for increasing the stability of said membranes during deformation thereof, wherein said rings are concentric to each other and parallel to a horizontal plane at said middle of said container and wherein said rings decrease in cross sectional surface area relative to one another from the peripheral edge of each of said membranes to the central portion thereof;

(d) an intake line and a delivery line connected to one chamber of each container for the intake and delivery of product, said pair of chambers being on the same side of the membrane in each container;

(e) a distribution box connecting the other pair of said chambers with a hydraulic pump to control the flow of hydraulic fluid therebetween;

(f) switching means connected to said containers and distribution box for causing said box to change the flow of hydraulic fluid from one of said containers to the other when the product in one of said containers has fully deformed said membrane therein, whereupon the product causing said deformation is decharged from said container into said delivery line.

2. The pumping device of claim 1, wherein each of said containers has a spherical shape.

3. The pumping device of claim 1, wherein said distribution box is of a four-way, three-position type.

4. The pumping device of claim 1, wherein said switching means includes a stop device in each of said containers, said stop device cooperating with the central part of a fully deformed membrane for exciting a device operatively connected to the distribution box for switching thereof.

5. The pumping device of claim 1, wherein said membrane is provided with a cloth made from natural (cotton) or synthetic material embedded therein.

* * * * *